US010306931B2

(12) United States Patent
Inzer

(10) Patent No.: US 10,306,931 B2
(45) Date of Patent: Jun. 4, 2019

(54) GRADUAL TILT SLEEVE SUPPORT SHIRT

(71) Applicant: John W. Inzer, Longview, TX (US)

(72) Inventor: John W. Inzer, Longview, TX (US)

( * ) Notice: Subject to any disclaimer, the term of this patent is extended or adjusted under 35 U.S.C. 154(b) by 155 days.

(21) Appl. No.: 14/657,268

(22) Filed: Mar. 13, 2015

(65) Prior Publication Data

US 2016/0262460 A1 Sep. 15, 2016

(51) Int. Cl.

| | |
|---|---|
| ***A41D 13/00*** | (2006.01) |
| ***A41B 1/08*** | (2006.01) |
| *A41D 27/10* | (2006.01) |
| *A41B 9/06* | (2006.01) |

(52) U.S. Cl.

CPC ..... *A41B 1/08* (2013.01); *A41D 13/0015* (2013.01); *A41B 9/06* (2013.01); *A41D 27/10* (2013.01)

(58) Field of Classification Search

CPC ..... A41B 9/06; A41B 1/08
USPC ..... 2/115
See application file for complete search history.

(56) References Cited

U.S. PATENT DOCUMENTS

| | | | | |
|---|---|---|---|---|
| 2,035,377 | A | 3/1936 | Redmond | |
| 2,858,541 | A * | 11/1958 | Mangan | A41B 9/06 2/113 |
| 3,694,818 | A * | 10/1972 | Nielson | A41H 31/00 112/475.09 |
| 4,473,908 | A | 10/1984 | Knecht | |
| 5,046,194 | A | 9/1991 | Alaniz et al. | |
| 5,383,235 | A | 1/1995 | Peters | |
| 5,829,058 | A | 11/1998 | Dicker et al. | |
| 5,957,878 | A | 9/1999 | Gilliam | |
| 6,446,264 | B2 | 9/2002 | Fairhurst et al. | |
| 6,892,396 | B2 | 5/2005 | Uno et al. | |
| D608,077 | S | 1/2010 | Bybee et al. | |
| 7,941,871 | B1 | 5/2011 | Jorgensen | |
| 7,958,569 | B2 * | 6/2011 | Razzaghi | A41D 13/0002 2/62 |
| 8,578,517 | B2 | 11/2013 | Alaniz et al. | |
| 2002/0078485 | A1 * | 6/2002 | Ferreiro | A41D 1/04 2/69 |
| 2005/0229283 | A1 * | 10/2005 | Towle | A41D 3/02 2/93 |
| 2006/0085889 | A1 | 4/2006 | Okajima | |
| 2007/0000015 | A1 * | 1/2007 | Alaniz | A41D 13/0015 2/115 |
| 2009/0113596 | A1 | 5/2009 | Young | |
| 2010/0077527 | A1 | 4/2010 | Lee et al. | |
| 2011/0167539 | A1 * | 7/2011 | Tatsuno | A41D 27/10 2/243.1 |
| 2013/0101781 | A1 * | 4/2013 | Lee | D02G 3/36 428/91 |

(Continued)

*Primary Examiner* — Katherine M Moran
(74) *Attorney, Agent, or Firm* — Dinsmore & Shohl, LLP

(57) ABSTRACT

A support shirt that provides support through the shoulders and across the chest of a wearer is provided. A gradual curvature or tilt of the sleeves of the support shirt toward the chest of the wearer provides additional support and prevents slack from occurring along the sleeves during weightlifting or other athletic or work activities. The sleeves are attached to the shirt body at sleeve arm holes. Each sleeve has at one end a sleeve opening and an opposite end which attaches to the shirt body. A centerline of the shirt forms a curvilinear axis and extends longitudinally across a front portion of the upper shirt body and the sleeves from the sleeve arm holes to the sleeve openings.

20 Claims, 21 Drawing Sheets

(56) References Cited

U.S. PATENT DOCUMENTS

2015/0082510 A1* 3/2015 Inzer ..... A41D 13/0015
2/125

* cited by examiner

GRADUAL TILT SLEEVE SUPPORT SHIRT

BACKGROUND

The subject matter described herein relates to a shirt or garment which covers the upper torso of a wearer. Specifically, embodiments described herein are directed to a support shirt providing support along the chest and shoulder regions of the wearer, and having a gradual tilt of the sleeves along an axis extending across the chest and front portions of the sleeves. The support shirt is useful for a variety of sporting or work activities where support of the chest and shoulders is desired, such as, for example, a bench press shirt for weightlifting, a shirt for mountain climbing, or a rodeo rider's shirt.

Bench press shirts aid in providing an increase in the amount of weight a bench presser can lift as well as providing increased safety to the bench presser. Typically, bench press shirts are made of materials with high tensile strength such as double knit polyester, canvas, or denim which are designed to fit the wearer tightly. Such bench press shirts have portions covering the sleeves and chest which may provide tightness during lifting. Bench press shirts can also be made of spandex type fabric and be effective for support. As distinguished from ordinary shirts or t-shirts, bench press shirts have at least one area of increased support/strength, designed to augment movement of a body part by increased strength of material and/or compression.

In a bench pressing exercise, a weightlifter lies substantially flat on his back, with arms upraised. The exercise involves lowering a weight to the chest and then pushing it vertically upward until the arms are straight. The tautness of the fabric in the bench press shirt provides assistance and increased support for the underlying muscles, thereby allowing the weightlifter to lift more weight.

Weightlifting shirts typically provide a peak area of support during a bench press, referred to as the "support bubble." Typically, the lifter tries to push the weight vertically upward in line with the support bubble of the bench press shirt. Shirt and lifter do not always have the perfect peak support area, so the lifter adjusts the bar path as much as possible to coincide with the peak of the shirt's support bubble. Moreover, the lifter can adjust the fitting position of the shirt to match the lifter's preferred bar path. For example, the lifter may adjust the position of the neck band of a bench press shirt, or may adjust the position of the sleeves in relation to the lifter's deltoid muscles. Lifters can also employ both techniques of adjusting the bar path in combination with adjusting the fitting position of the shirt. However, such shirts often do not provide sufficient shoulder reinforcement for the lifter during elevation and descent of a weight through the bar path.

Other problems exist in prior bench press shirts. During a bench press exercise, slack may exist in the material of the shirt just below the lifter's arm from the front deltoid muscle. The slack material tightens up as the bar is lowered. Additionally bench press shirts may tear or shred at the shoulder seams and neck area where the most the stress occurs. Thus, a problem that exists in the construction of prior art bench shirts is the lack of support across the shoulders of a wearer throughout the bar path of the bench press exercise.

Attempts have been made to provide a bench press shirt providing support in the arms and shoulders of a wearer. For example, U.S. Pat. No. 5,383,235 describes a shirt wherein the circumference and tightness of the area across the upper torso is less than that of the area around the waist. U.S. Pat. No. 8,578,517 describes an athletic garment wherein seams twist the garment fabric and sleeves.

Other shirt designs focus on the type of material and configuration of compressible fabrics used across the upper chest. Such designs employ fabric or material across the upper portion of the shirt which fails to reinforce the shoulders of a wearer during the bench press exercise. Additionally, such designs fail to solve the problem of preventing slack or fabric tearing. Therefore, a need still exists in the art for a shirt which provides support across the shoulders and chest of the wearer throughout elevation and descent of the weight through the bar path of a bench press exercise. There is also a need for a shirt that provides support across the shoulders and chest of a wearer for a variety of sporting or work activities.

SUMMARY

This need is addressed by embodiments of the present invention which provide a shirt that provides support through the shoulders and across the chest of the wearer throughout the bar path of a bench press exercise. Embodiments of the present invention also provide a gradual curvature or tilt of the sleeves of the support shirt toward the chest of the wearer. The gradual curvature or tilt of the sleeves provides additional support and prevents slack from occurring along the sleeves during weightlifting or other athletic or work activities.

In one embodiment, a support shirt has a shirt body having at least one section comprised of a supporting fabric extending across the upper torso of the wearer. Respective front and back sleeve portions are also comprised of supporting fabric and are attached to the shirt body. Preferably, the fabric comprising the shirt body and sleeves has a tensile strength sufficient to withstand the stresses and strains imposed by lifting and supporting heavy weights without fabric tearing. Each sleeve portion has at one end a sleeve opening and an opposite end which attaches to the shirt body, and in some embodiments, to a respective sleeve arm hole. The support shirt includes at least one area of increased support comprising a tilt region which extends along at least a portion of a centerline forming a curvilinear axis along an upper portion of the shirt body and extending across a front portion of the sleeves from the sleeve arm holes to the sleeve openings. This area of increased support stabilizes and provides support to the shoulders of a wearer during a lifting motion such as, for example, an upward or forward lifting motion.

The tilting region causes the sleeve portions, and/or the upper portion of the shirt body, to gradually curve or tilt toward the chest of the wearer, resulting in a gradual curvature along the centerline of the support shirt. In one embodiment, the tilting region comprises a plurality of darts formed on each front sleeve portion and arranged generally perpendicular to the centerline. As used herein, the terms "dart" or "darts" are used in their broad sense of, for example, an oval-shaped or diamond-shaped tapered adjustment to the fabric, gathering the fabric in the area where the dart is positioned. As used herein, a "dart" may be a fold in the fabric which is stitched together, or a dart may be a cut-out section of fabric, the opposite sides of which are gathered and stitched together to form a seam.

Also as used herein, the term "dart" is also meant to encompass fabric puckering, where the fabric is either gathered in small wrinkles or folds causing the fabric to draw or contract or the fabric is woven or knitted to create puckered or gathered areas. The darts which are formed may be fixed or adjustable. With respect to the latter, the darts may be made to be adjustable using zippers, Velcro®, buttons, snaps, or the like positioned on opposing sides of the cutout areas on the sleeve which form the darts.

Other embodiments herein include a tilting region comprising more than one dart formed on each of the front sleeve portions. Moreover, each dart may differ in length and amount of gather. The result of the use of such darts is to cause a gradual curvature of the sleeves across the centerline of the shirt, as opposed to causing axial twisting of the sleeves.

In other embodiments, the tilt region is located on the shirt body. For example, the dart or series of darts may be positioned across the chest of the shirt body, typically in the area between arm holes. This gathering of fabric in the chest region of the shirt causes the inward tilt of the sleeves. The darts may be formed as described above using cut-outs and stitching. Alternatively, the tilt region may be formed by gathering (puckering) the fabric into darts in either the sleeves or chest region of the shirt and laminating, for example by welding, stitching, or adhering, a strip of material over the darts.

In a further embodiment, the tilting region of the support shirt comprises a waveform pattern along the centerline. The sleeve portions of the support shirt include a plurality of recesses and projections which form the outer periphery of the seam.

The shirt body and sleeve portions of the support shirt are comprised of high tensile strength fabric. As used herein, the term "fabric" is meant to include not only woven materials, but also nonwoven materials such as, for example, substantially continuous sheets of polymeric materials. The shirt is designed to provide a taut fit when worn. The shirt body and sleeve members may be the same or of different material. Both the shirt body and sleeve members may be stretchable or non-stretchable material. The shirt body may or not have a back or a lower portion.

It is a feature of embodiments of the present invention to provide a support shirt with a supporting fabric across the torso of an individual. It is a further feature of embodiments of the present invention to provide a support shirt with a gradual inward curvature or tilt along a centerline forming a curvilinear axis and extending across the front portions of the sleeves. Other features and advantages of the present invention will be apparent from the following detailed description, the accompanying drawings, and the appended claims.

BRIEF DESCRIPTION OF THE SEVERAL VIEWS OF THE DRAWINGS

The following detailed description of specific embodiments of the present invention can be best understood when read in conjunction with the following drawings, where like structure is indicated with like reference numerals and in which.

DETAILED DESCRIPTION

Figure 1:
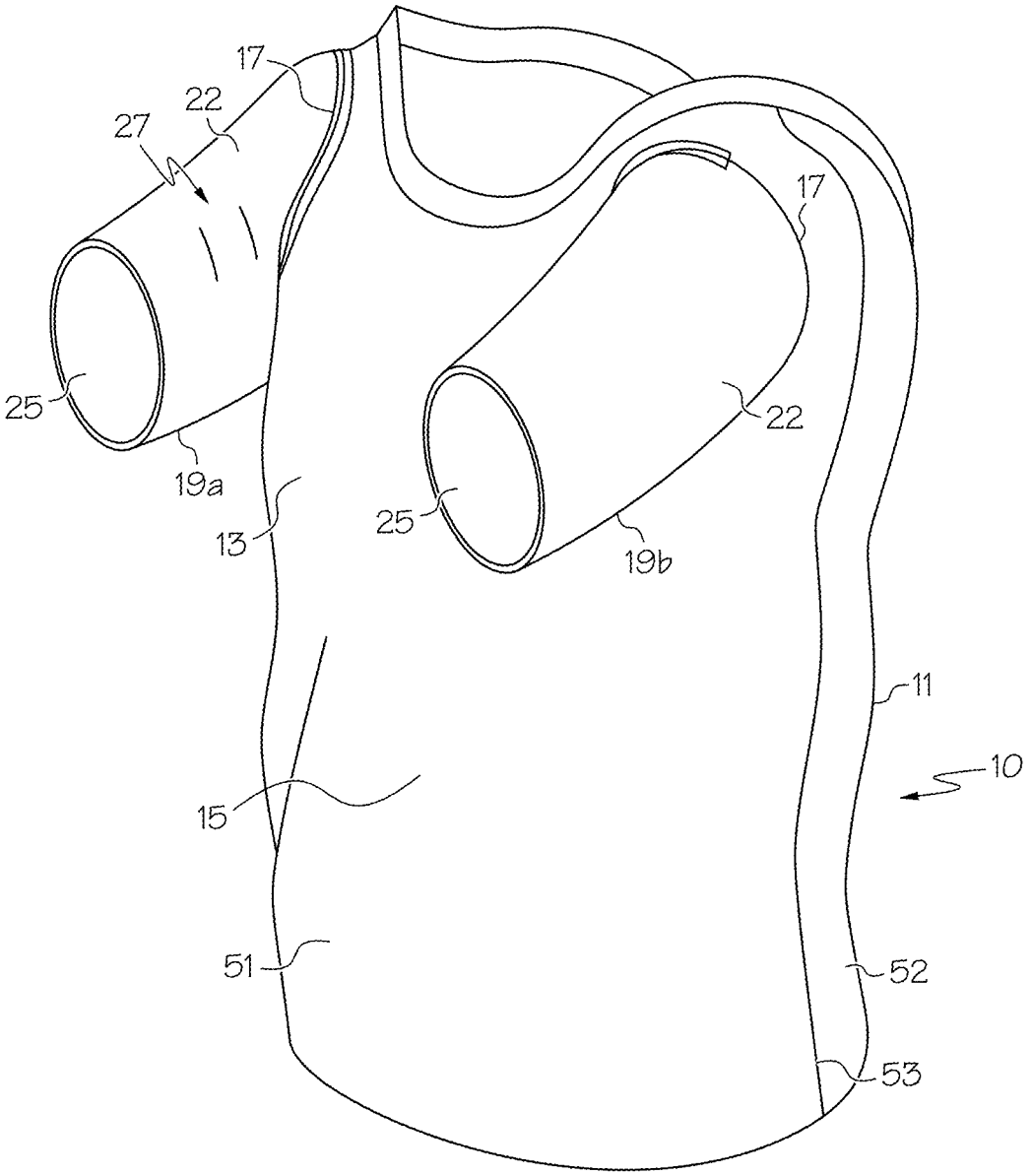
FIG. 1 illustrates a perspective view of the support shirt of one embodiment of the present invention.
Figure 26:
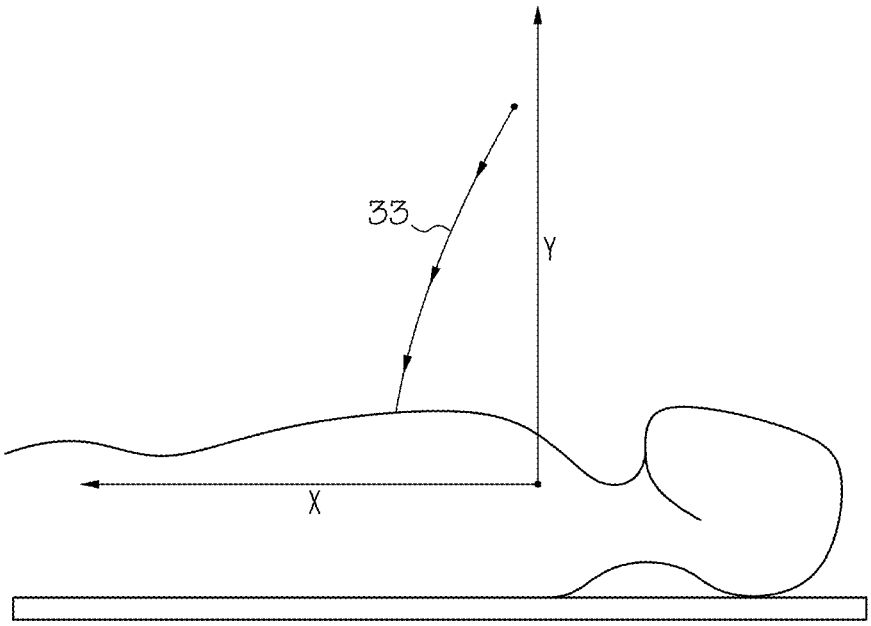
FIG. 26 illustrates an example of a bar path during a bench press exercise.

Referring initially to FIG. 1, in an exemplary embodiment of the invention, a support shirt 10 comprises a shirt body 11 worn across the torso of an individual. The shirt body 11 comprises an upper shirt body 13 and lower shirt body 15. Additionally, the shirt body 11 has a shirt front 51 and shirt back 52 joined at a body seam 53. The shirt body 11 is comprised of a supporting fabric extending across at least upper shirt body 13. The support shirt is sized so that the supporting fabric is taut against the wearer's body, providing support across the upper torso and shoulders of the individual. The tautness of the fabric provides increased pressure exerted across the pectoralis major and serratus anterior muscles of the wearer. During an exercise such as a bench press, the shirt body 11 provides support as the bar is raised and lowered through a bar path 33 as shown in FIG. 26.

The fabric may be comprised of stretchable or non-stretchable material. Additionally, the fabric may be single ply or multi-ply and may be comprised of: canvas fabric; polyester; spandex type fabric; nylon fabric; cotton; or any kind of fabric that holds tautness when worn. Further, the shirt body and sleeves may be comprised of polymeric material having a suitable thickness to provide the requisite tensile strength. Sleeve arm holes 17 are positioned in upper shirt body 13, corresponding with the area of traversal of the wearer's arms. In one embodiment, the fabric comprising shirt body 11 has a tensile strength which will withstand the stresses and strains of lifting from several hundred to one thousand pounds of weight without fabric tearing. Preferably, the fabric has a tensile strength of at least about 90 psi. The type of fiber, denier, and weight of the fabric will all affect the tensile strength.

Figure 2:
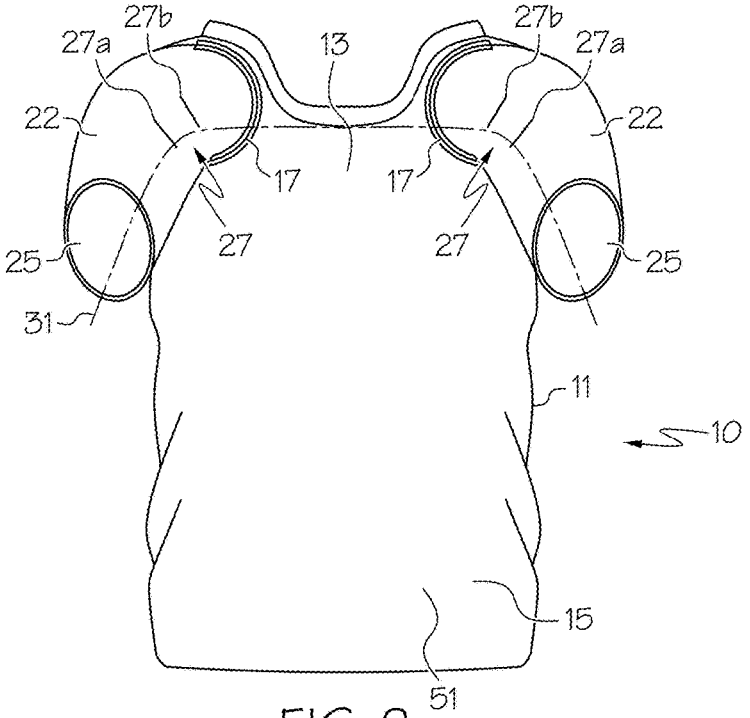
FIG. 2 illustrates a front view of the support shirt of FIG. 1.
Figure 3:
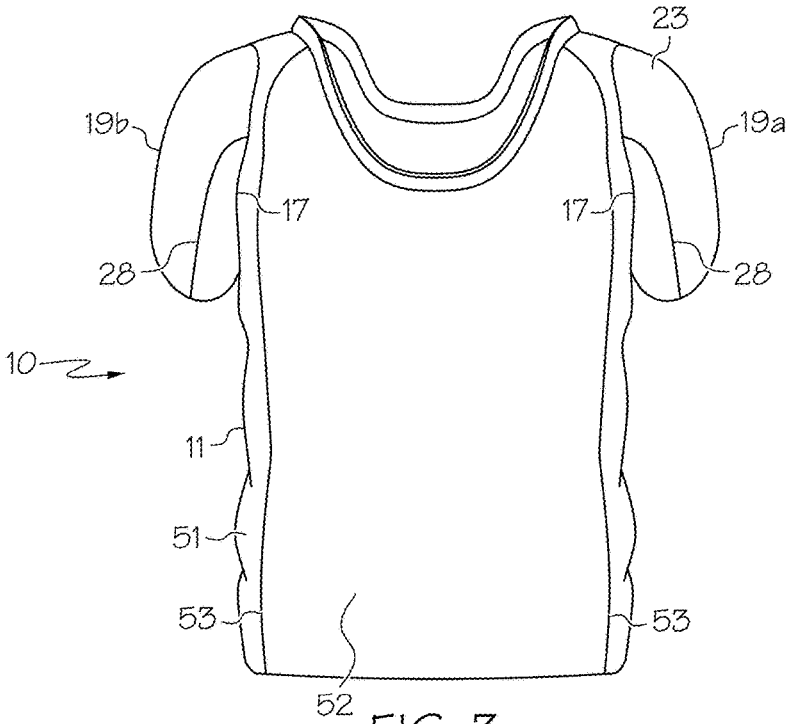
FIG. 3 illustrates a back view of the support shirt of FIG. 1.

Sleeve openings 25 oppose the sleeve arm holes 17. The sleeve portions 19*a*, 19*b* comprise front sleeve portions 22, and rear sleeve portions 23 as shown in FIGS. 2 and 3. Sleeve portions 19*a* and 19*b* are attached to the shirt body 11 at the sleeve arm holes 17 as shown in FIG. 2. The sleeve portions 19*a* and 19*b* provide compression across the shoulders of the wearer corresponding to the anterior deltoid, coracobrachialis, scapulae fixer, biceps, and triceps of the wearer. The sleeve portions 19*a* and 19*b* are comprised of a high tensile strength fabric material and are designed to closely fit the arms of a wearer to provide support for the shoulders during lifting. The fabric may be comprised of stretchable or non-stretchable material. Additionally, the fabric may be single ply or multi-ply and may be comprised of: canvas fabric; polyester; spandex type fabric; nylon fabric; cotton; or any kind of fabric that holds tautness.

Figure 4:
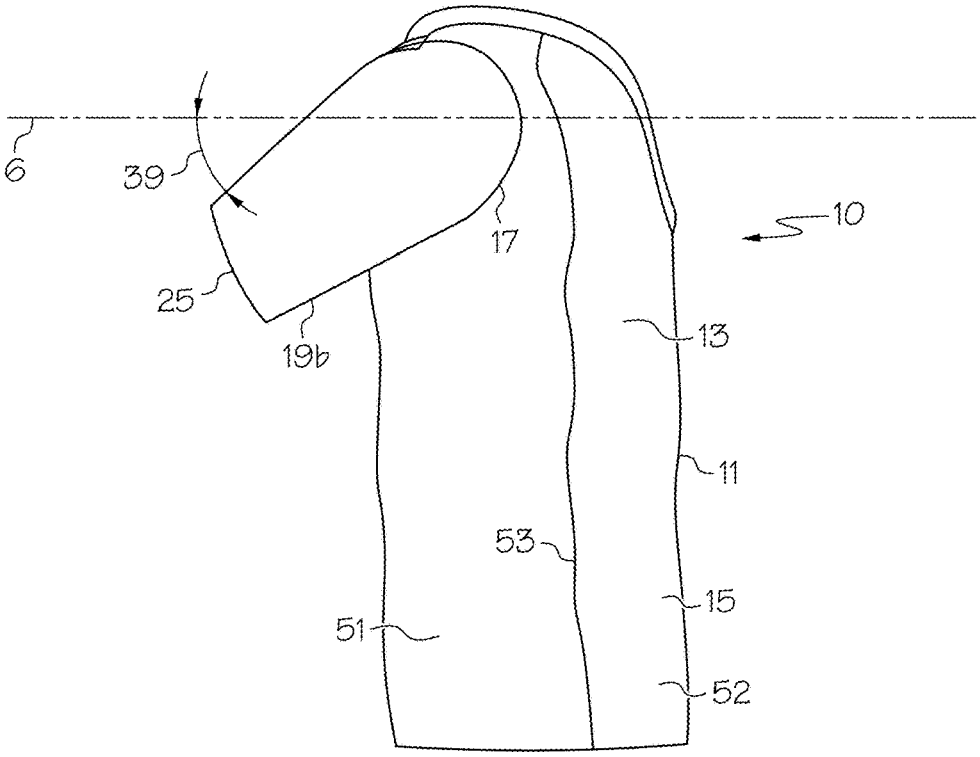
FIG. 4 illustrates a side view of the support shirt of FIG. 1.
Figure 5:
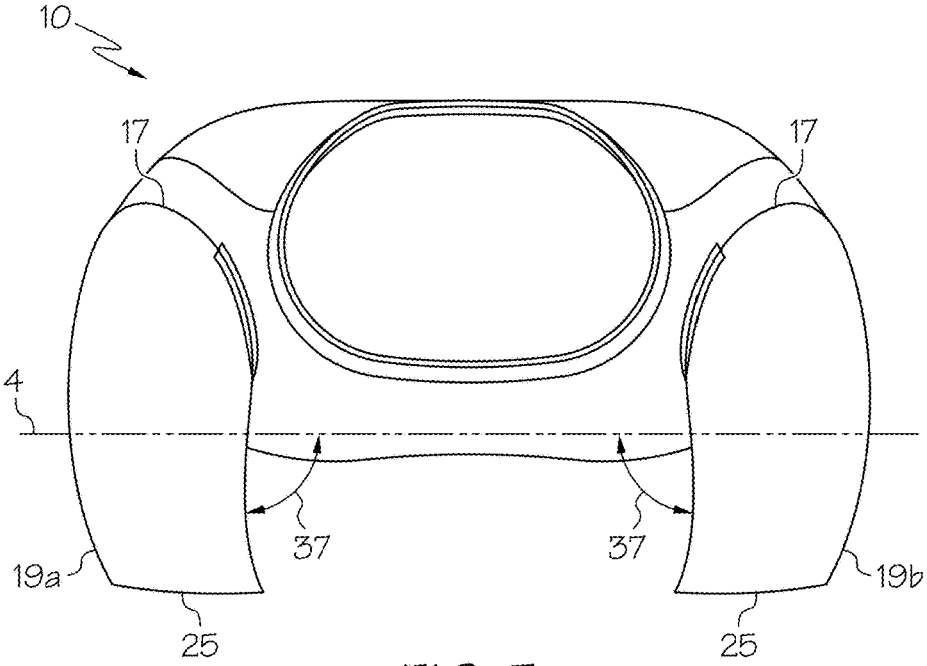
FIG. 5 illustrates a top view of the support shirt of FIG. 1.

In one embodiment, the sleeve portions 19*a* and 19*b* extend in a forward direction relative to a frontal plane 4 of the shirt body 11, and in a downward direction relative to a transverse plane 6 of the shirt body 11 as shown in FIGS. 4 and 5. As shown in FIG. 5, sleeve portions 19 have a first central angle 37 of approximately 95° relative to the frontal plane 4. However, angle 37 may vary over a broad range depending on the desired use of the shirt. For example, angle 37 may vary between about 60° to about 180°. As shown in FIG. 4, sleeve portions 19*a* and 19*b* have a second central angle 39 of approximately 30° relative to the transverse plane 6 of the shirt body 11. However, angle 39 may also vary over a broad range depending on the desired use for the shirt. For example, angle 39 may vary between an upward angle of about 45° to a downward angle of about 45° relative to transverse plane 6. In one embodiment, the sleeve portions 19*a* and 19*b* have strengths sufficient to withstand the stresses of lifting heavy weights.

Figure 25:
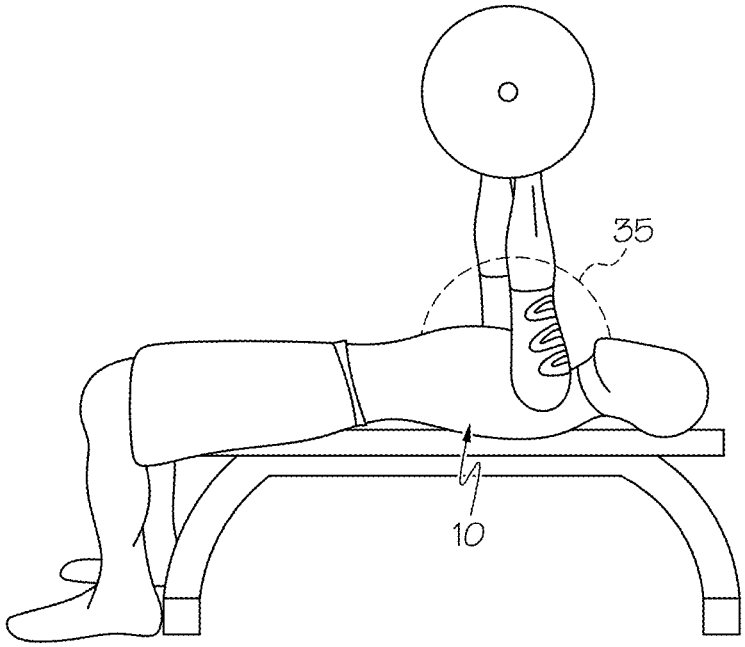
FIG. 25 illustrates a side view of an individual wearing a support shirt, and shows the support bubble during a bench press exercise.

FIG. 25 illustrates a support bubble 35 during a bench press exercise, according to embodiments of the invention. The support bubble 35 represents an area of maximum support for the wearer of support shirt 10. During the bench press exercise, the lifter presses the bar generally vertically upward within the support bubble 35. Bench press shirts are designed to provide maximum support at the most natural point of pressing for the lifter, defined as the position where the lifter has pressed the weight to the position shown in FIG. 25, immediately beneath centerline 31. See, e.g., FIG. 2.

Figure 23:
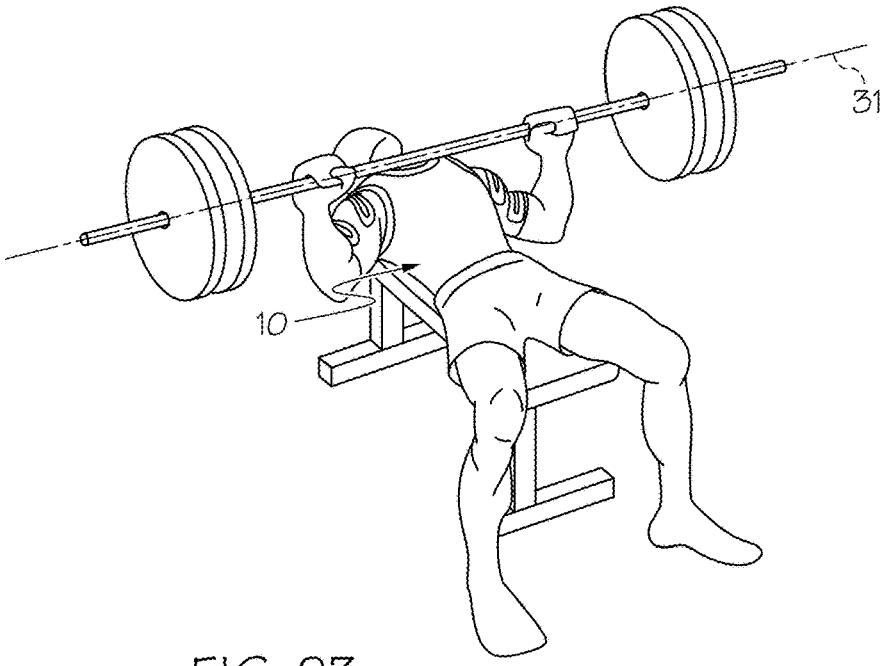
FIG. 23 illustrates a perspective view of an individual wearing a support shirt, and shows the centerline of the shirt during a bench press exercise.
Figure 24:
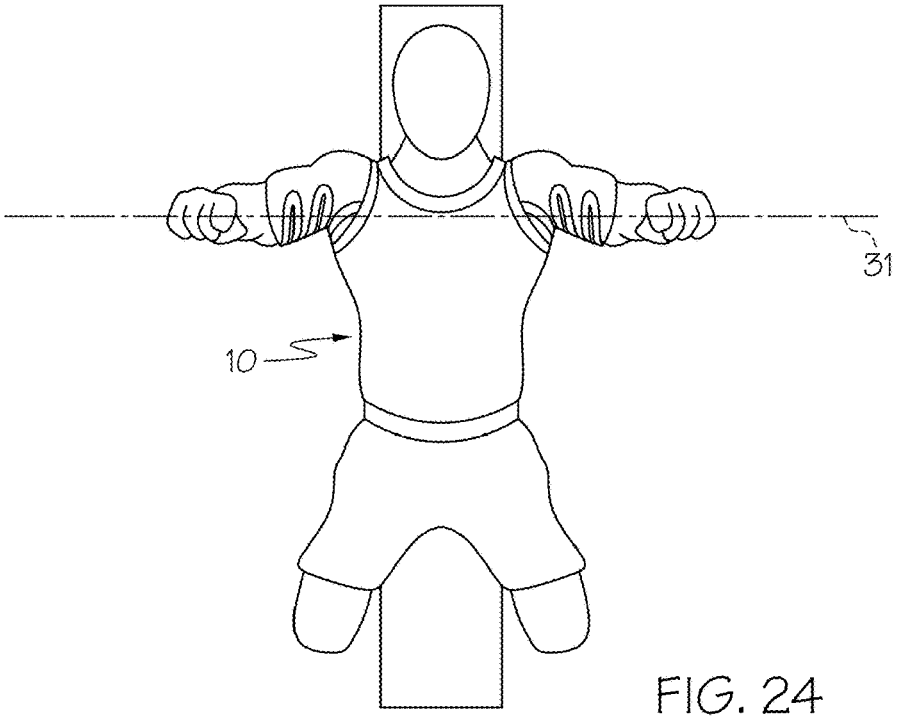
FIG. 24 illustrates a top view of an individual wearing a support shirt, and shows the approximate centerline of the shirt during a bench press exercise.

The centerline 31 delineates the longitudinal axis of the weightlifting bar as shown in, for example, FIGS. 23 and 24. A vertical plane extending downwardly from centerline 31, within support bubble 35 corresponds to an area of maximum support for the shirt 10. This area of support extends below sleeve body holes 17 and corresponds with the longitudinal axis of the bar during the bench press exercise. The plane extending downwardly from centerline 31 extends across the upper torso of the individual and the frontal shoulder areas and forms a curvilinear axis on the support shirt as shown in FIG. 2. According to one embodiment, the plane extending downwardly from centerline 31 extends across the bench press shirt 10 and the lifter's body above the serratus anterior and pectoralis major muscles.

Figure 6A:
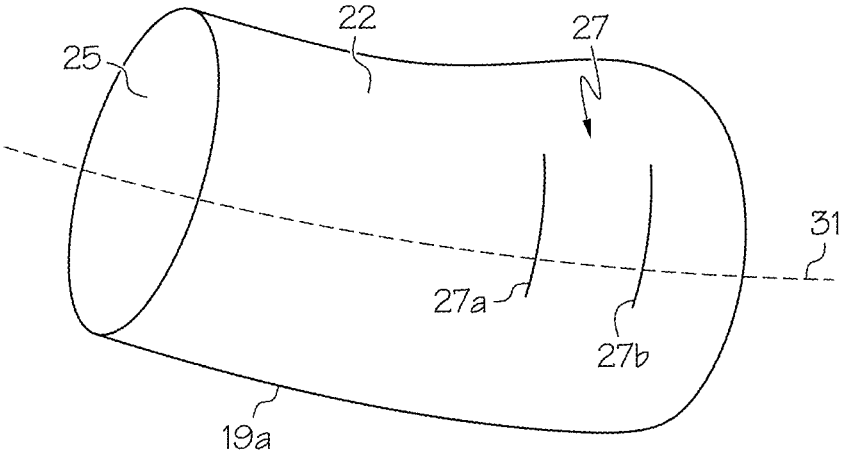
FIG. 6A illustrates a side view showing sewn darts of a sleeve portion of the support shirt of FIG. 1.

As shown in FIGS. 2 and 3, the sleeve portions 19*a* and 19*b* are joined at seams 28 which are located on the rear sleeve portions 23. A curved tilting region 27 is located on each of the sleeve portions 19*a* and 19*b* located on the front sleeve portions 22. The tilting region 27 comprises, for example, darts 27*a* and 27*b*, on the front sleeve portions 22. The darts 27*a* and 27*b* extend substantially perpendicular to and across the centerline 31 as shown in FIGS. 2, 6A, and 6B.

Figure 6B:
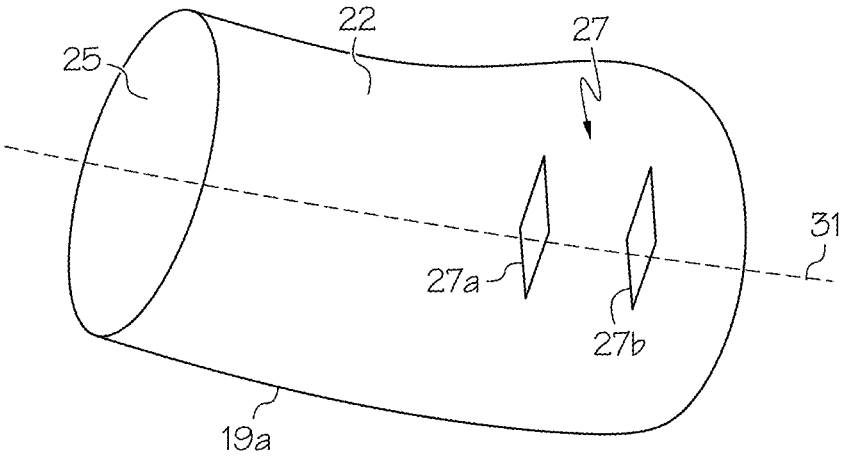
FIG. 6B illustrates a side view showing unsewn cut-outs in a sleeve portion of the support shirt of FIG. 1.

In this embodiment, exemplary darts 27*a* and 27*b* are formed by cutting apertures in the fabric, as shown in FIG. 6B. It is within the scope of the present invention to include additional darts in the tilting region 27. Typically, the apertures are diamond-shaped and are bisected by centerline 31. Other cut-out shapes can be used as well. Generally, the darts may be from about 0.5 to about 2.0 inches long. The opposing sides of darts 27*a* and 27*b* are then gathered and stitched together as shown in FIG. 6A. The inclusion of darts 27*a* and 27*b* cause the sleeve portions 19*a* and 19*b* to gradually curve or tilt inwardly along the outer periphery of the front sleeve portions 22, causing a gradual curvature of centerline 31 as can be seen in greater detail in FIG. 6C. As can be seen from FIGS. 6A, 6B, and 6C, the sleeve portions 19*a* and 19*b* extend forwardly from the shirt body 11 in a path between the sleeve arm holes 17 and the sleeve openings 25. At the point where each dart 27*a* and 27*b* is located, the path followed by the sleeve portions gradually changes and forms a series of line segments that approximate a curved path along centerline 31. The result of the plurality of darts in the sleeve portions of the shirt is a gradual curvature or tilt of the sleeve portions as shown in FIG. 6C such that central angle 37 as shown in FIG. 5, when measured from succeeding darts 27*a*, 27*b*, . . . , decreases gradually from its initial angle θ to an angle of θ−X, where X varies from 0 to about 20°.

In other embodiments of the invention, the darts may be formed by folding the fabric and stitching it together. A dart may also be formed by causing the fabric to pucker, where the fabric is either gathered in small wrinkles or folds. Alternatively, the darts may be formed by weaving or knitting the fabric in a manner that creates puckered or gathered areas. Any darts which are formed may be fixed or adjustable. With respect to the latter, the darts may be made to be adjustable using zippers, Velcro®, buttons, snaps, or the like positioned on opposing sides of the cutout areas on the sleeve which form the darts.

The fabric and structure comprising the upper shirt body 13, lower shirt body 15, and sleeve portions of the support shirt 10 of the embodiment differs from conventional shirts or t-shirts. As distinguished from a conventional shirt or t-shirt, the support shirt 10 has at least one area of increased support/strength, designed to augment movement of a body part by providing increased tensile strength of material and/or compression. Support shirt 10 utilizes such a supporting fabric with a greater tensile strength and thickness than ordinary shirts. Moreover, support shirt 10 utilizes fabric which utilizes compression and support across the chest area, thereby allowing support for athletic activities such as bench pressing exercises. The tilting regions 27 extend this area of support along the shoulders through the path of the plane extending downwardly from centerline 31. Thus, support shirt 10 naturally augments motion of the wearer's arms forward from the frontal plane of the wearer's body during athletic activities such as bench press exercises.

Figure 6C:
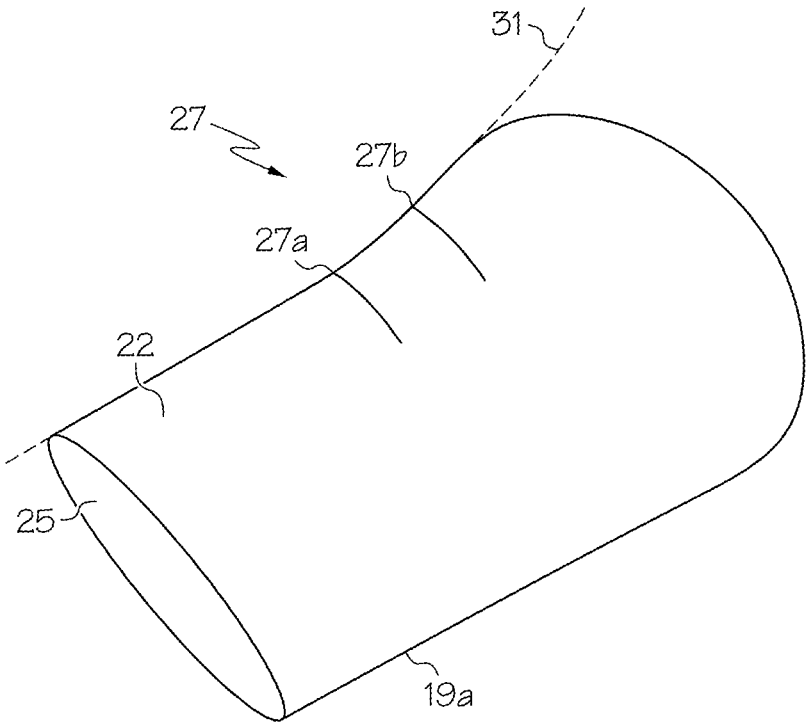
FIG. 6C illustrates a perspective view of a sleeve portion showing the gradual inward curvature/tilt of the sleeve portion of FIG. 1 along the centerline.
Figure 7:
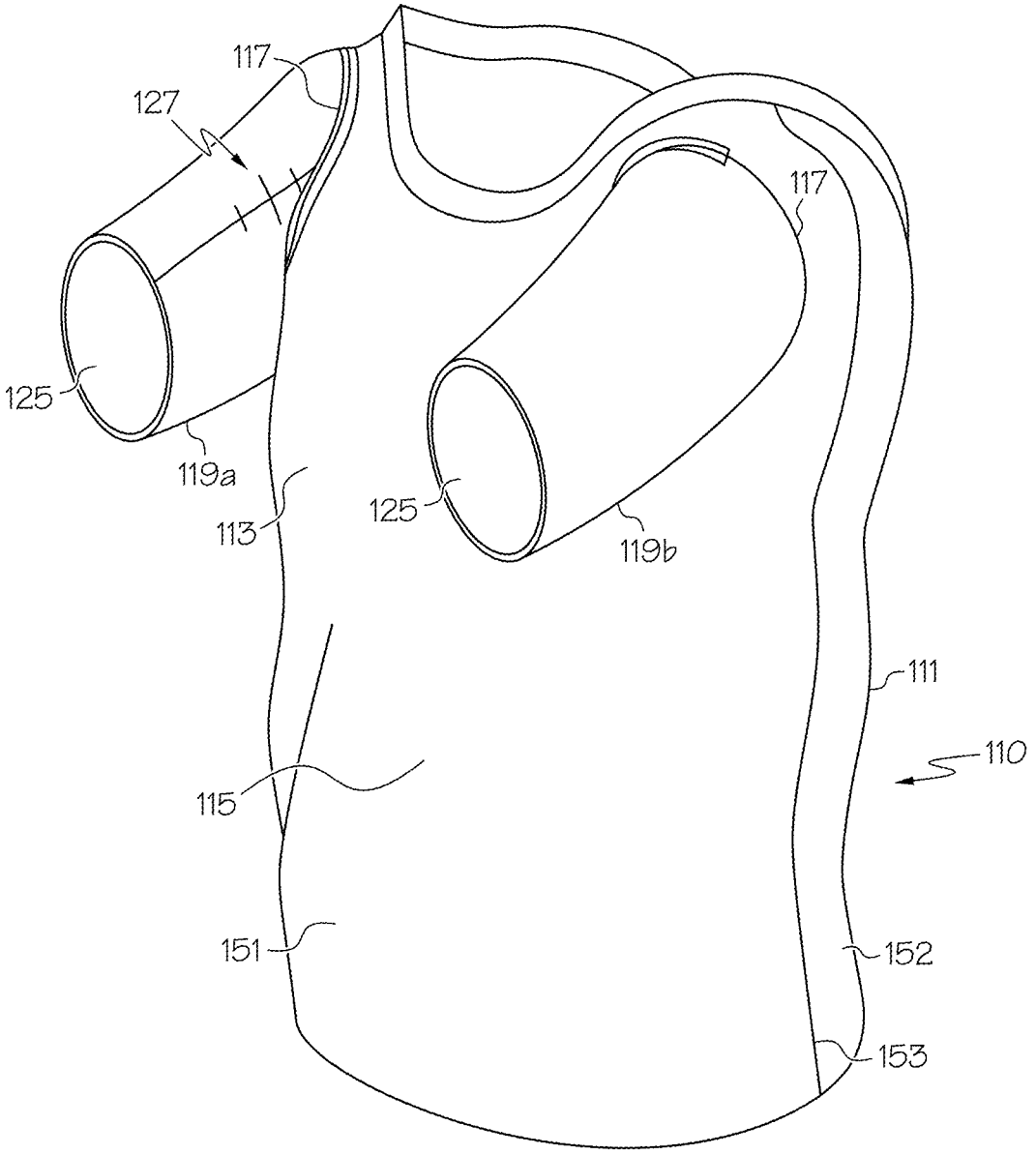
FIG. 7 illustrates a perspective view of a support shirt according to an alternate embodiment.

The purpose of tilting regions 27 is to gradually curve or tilt sleeve portions 19 inwardly along centerline 31 as shown in FIG. 6C. As defined herein, the terms gradually tilt and gradually curve are used to define the curvature on the periphery of sleeve portions 19*a* and 19*b* as shown in FIGS. 6A-6C. As distinguished from twisting of the sleeves, the tilting regions 27 of the sleeve portions 19*a* and 19*b* causes the periphery of the sleeves to tilt and form a curvilinear path along centerline 31 such that a path from sleeve arm holes 17 to sleeve openings 25 follows a parallel curvilinear path to that of tilting regions 27. As shown in FIGS. 2 and 6A-6C, tilting regions 27 extend substantially between sleeve arm holes 17 and sleeve openings 25, and do not cause sleeve portions 19*a* and 19*b* to twist.

Figure 8:
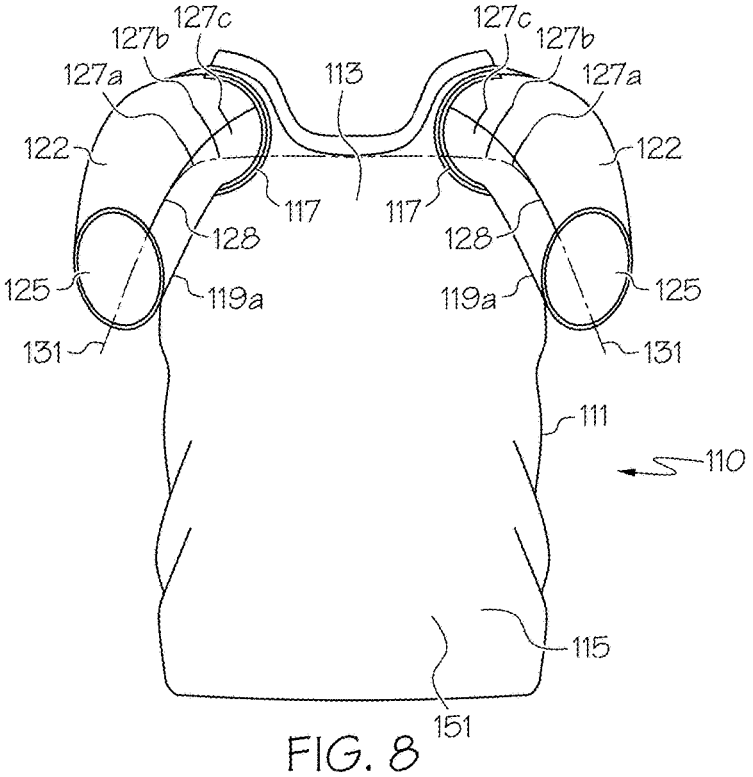
FIG. 8 illustrates a front view of the support shirt of FIG. 7.
Figure 9:
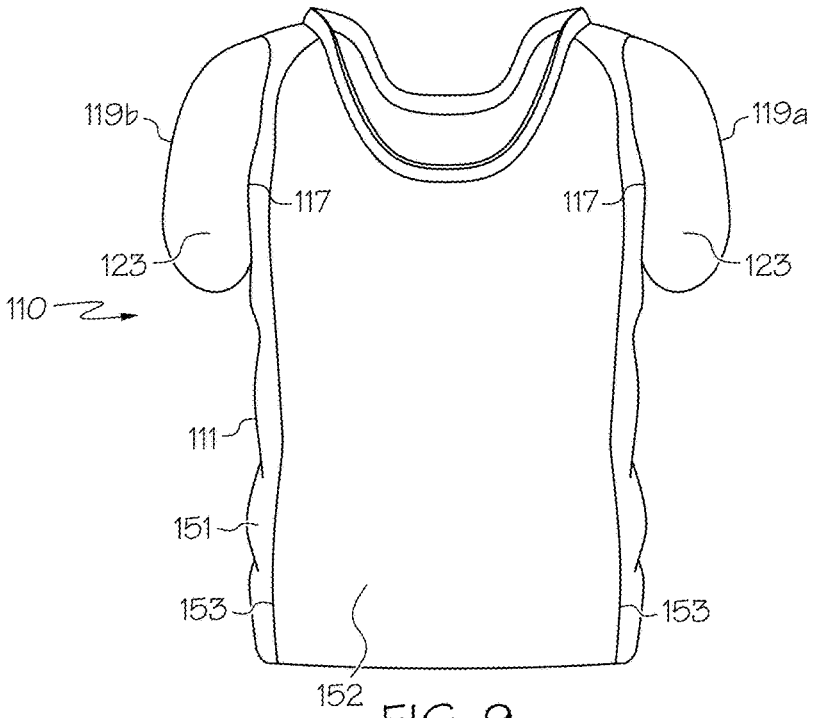
FIG. 9 illustrates a back view of the support shirt of FIG. 7.

Although the present invention has been described in considerable detail with reference to certain embodiments thereof, other embodiments are also contemplated. As shown in an alternate embodiment in FIGS. 7-12, support shirt 110 comprises a shirt body 111, upper shirt body 113, lower shirt body 115, sleeve arm holes 117 and sleeve portions 119*a* and 119*b*. Additionally, the shirt body 111 has a shirt front 151 and shirt back 152 joined at a body seam 153. The sleeve arm holes 117 are positioned near upper shirt body 113, corresponding with the area of traversal of the wearer's arms. Sleeve openings 125 oppose the sleeve holes 117. Sleeve portions 119*a* and 119*b* comprise front sleeve portions 122, and rear sleeve portions 123. A centerline 131 extends along the front sleeve portions 122 and upper shirt body 113 as shown in FIG. 8.

The sleeve portions have a seam 128, located on the front sleeve portions 122. The seam 128 extends substantially collinear with the centerline 131. Tilting regions 127 are located on front sleeve portions 122. In this embodiment the tilting regions include three darts 127*a*, 127*b*, and 127*c*, see FIGS. 12A and 12B, sewn such that the darts are substantially perpendicular to and bisect seams 128. As shown in greater detail in FIGS. 12A-12C, the darts 127*a*, 127*b*, and 127*c* are formed initially as diamond-shaped cut-outs which, when gathered and sewn together, cause sleeve portions 119*a* and 119*b* to gradually tilt and curve inwardly along curved centerline 31.

Figure 10:
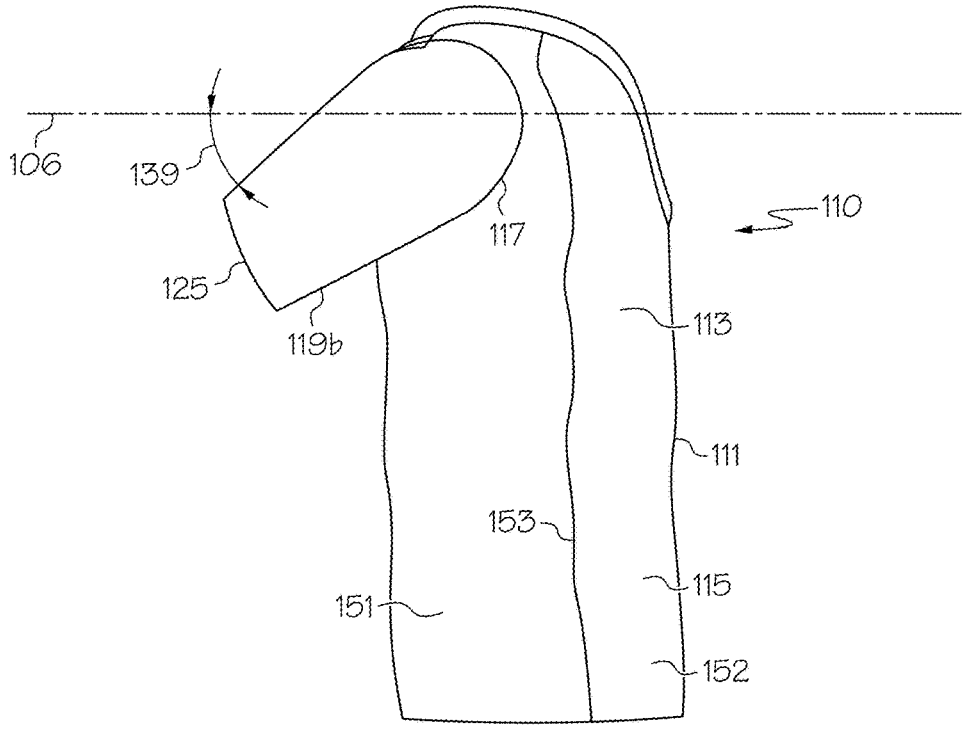
FIG. 10 illustrates a side view of the support shirt of FIG. 7.
Figure 11:
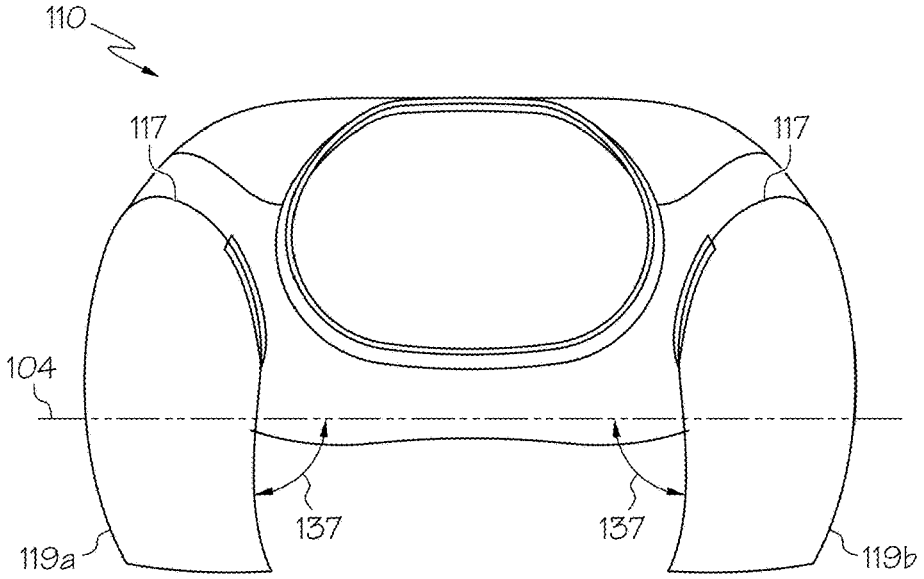
FIG. 11 illustrates a top view of the support shirt of FIG. 7.
Figure 12A:
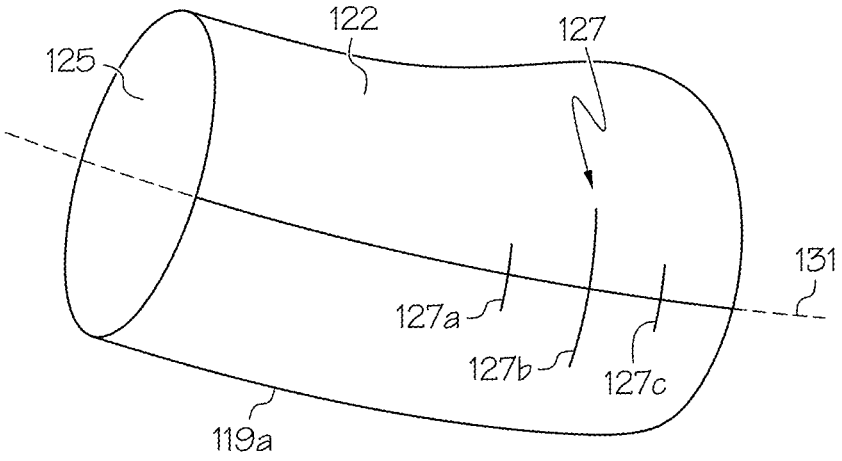
FIG. 12A illustrates a side view showing sewn darts of a sleeve portion of the support shirt of FIG. 7.
Figure 12B:
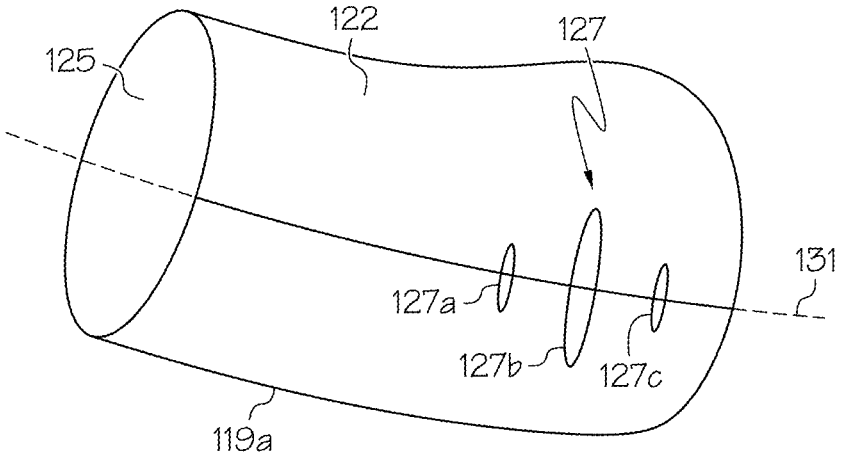
FIG. 12B illustrates a side view showing unsewn cut-outs of a sleeve portion of the support shirt of FIG. 7.
Figure 12C:
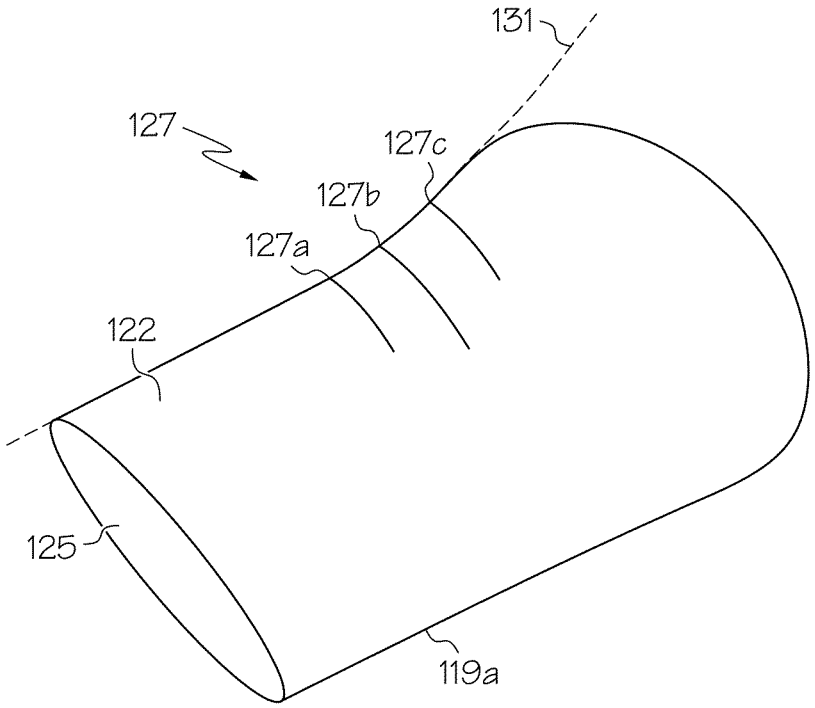
FIG. 12C illustrates a side view showing darts formed from the cut-outs of FIG. 12B.
Figure 13:
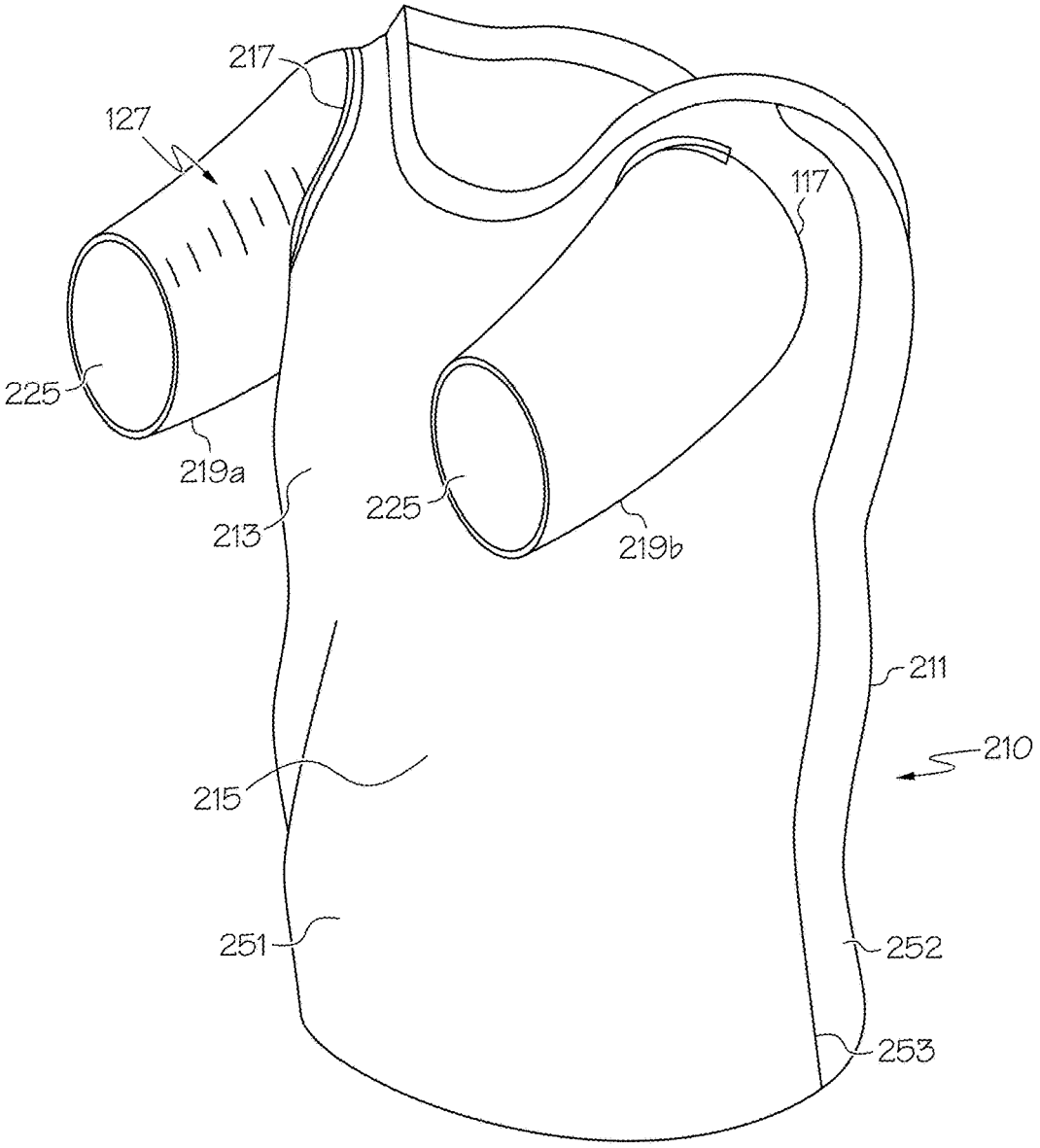
FIG. 13 illustrates a perspective view of a support shirt, according to a further alternate embodiment.

Sleeve portions 119*a* and 119*b* extend forwardly relative to frontal plane 104 of shirt body 111 and downwardly relative to transverse plane 106 of shirt body 111 as best shown in FIGS. 10 and 11. As shown in FIG. 11, sleeve portions 119*a* and 119*b* have a first central angle 137 of approximately 95° relative to frontal plane 104. However, angle 137 may vary over a broad range depending on the desired use for the shirt. As shown in FIG. 10, sleeve portions 119*a* and 119*b* have a second central angle 139 of approximately 30° relative to transverse plane 106 of shirt body 111. Again, however, such angle can vary broadly between an upward angle of about 45° and a downward angle of about 45° relative to the transverse plane.

Figure 14:
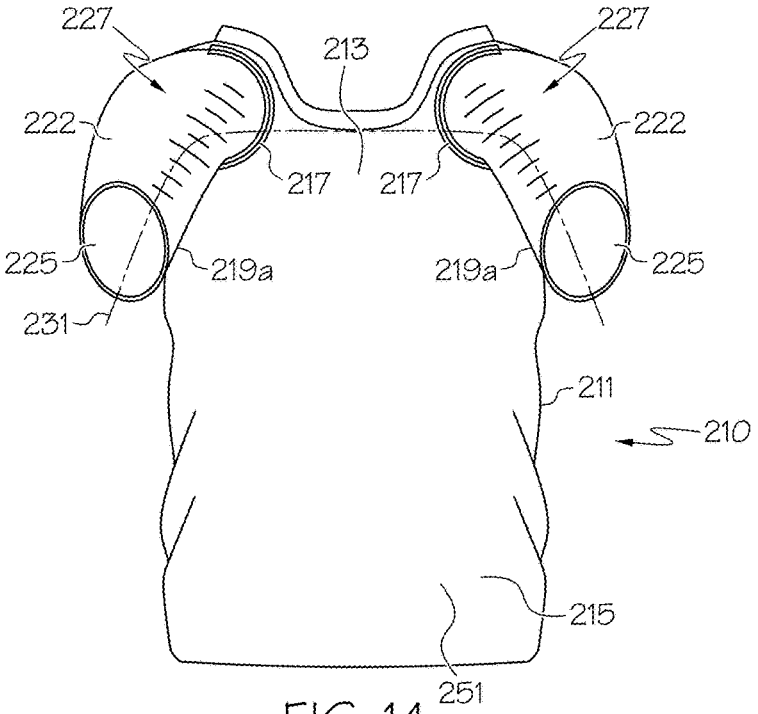
FIG. 14 illustrates a front view of the support shirt of FIG. 13.
Figure 15:
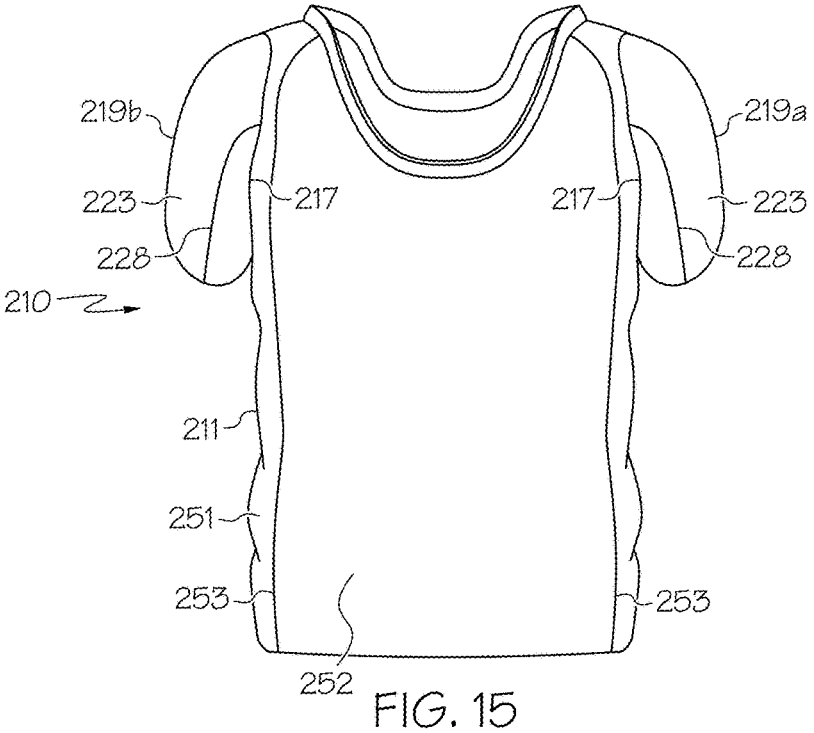
FIG. 15 illustrates a back view of the support shirt of FIG. 13.

A further alternate embodiment is shown in FIGS. 13-18. In this embodiment, support shirt 210 comprises a shirt body 211, upper shirt body 213, lower shirt body 215, sleeve arm holes 217 and sleeve portions 219*a* and 219*b*. Additionally, the shirt body 211 has a shirt front 251 and shirt back 252 joined at a body seam 253. The sleeve arm holes 217 are positioned near the upper shirt body 213, corresponding with the area of traversal of the wearer's arms. Sleeve openings 225 oppose the sleeve holes 217. Sleeve portions 219*a* and 219*b* comprise front sleeve portions 222, and rear sleeve portions 223. A centerline 231 extends along the front sleeve portions 222 and upper shirt body 213 as best shown in FIG. 14.

The sleeve portions have a seam 228, located on the rear sleeve portions 223. Tilting regions 227 are located on each of the front sleeve portions 222. In this embodiment, the tilting regions 227 include nine darts 227*a*-227*i* sewn such that the seams of the darts are substantially perpendicular to and bisect centerline 231. As shown in FIGS. 13-18, the diamond-shaped cut-outs forming darts 227*a*-227*i* differ in length. The darts 227*a*-227*i* cause sleeve portions 219*a* and 219*b* to gradually curve or tilt inwardly along centerline 231. By changing the length of the darts, the curvature of sleeve portions can be varied to achieve an overall desired degree of curvature.

Figure 16:
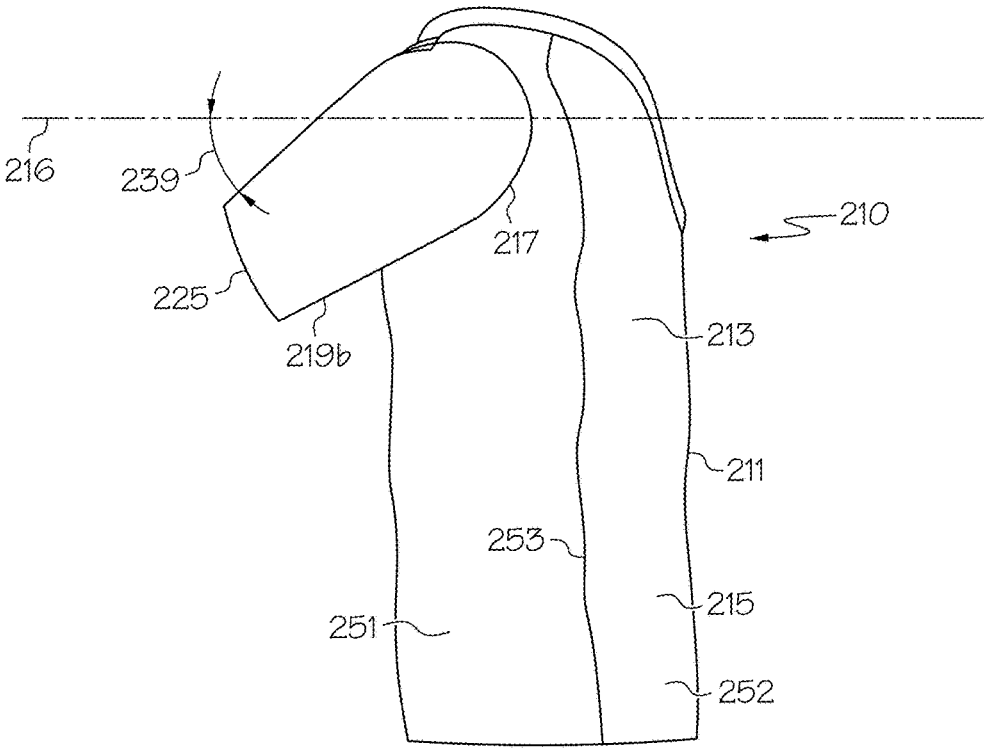
FIG. 16 illustrates a side view of the support shirt of FIG. 13.
Figure 17:
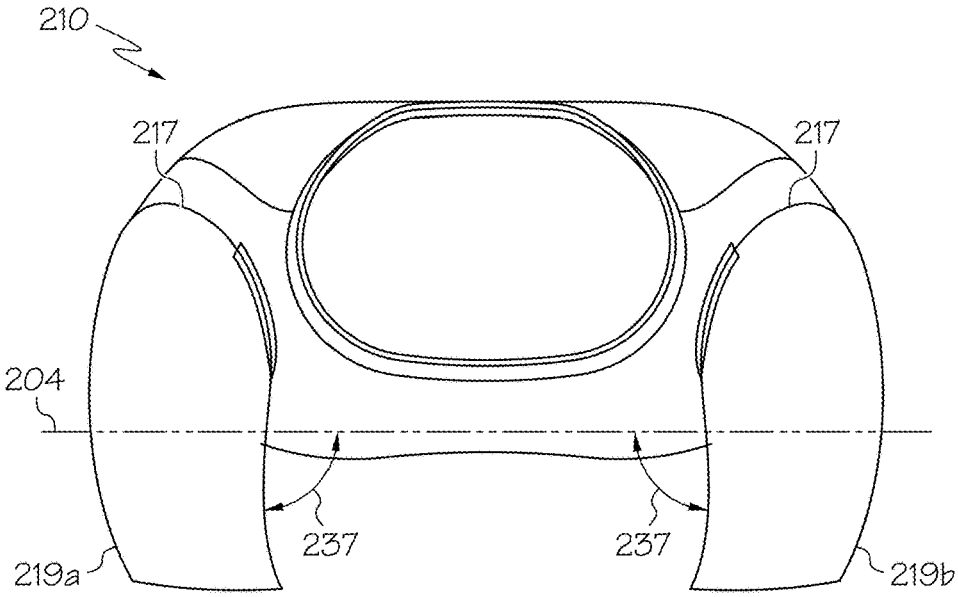
FIG. 17 illustrates a top view of the support shirt of FIG. 13.
Figure 18A:
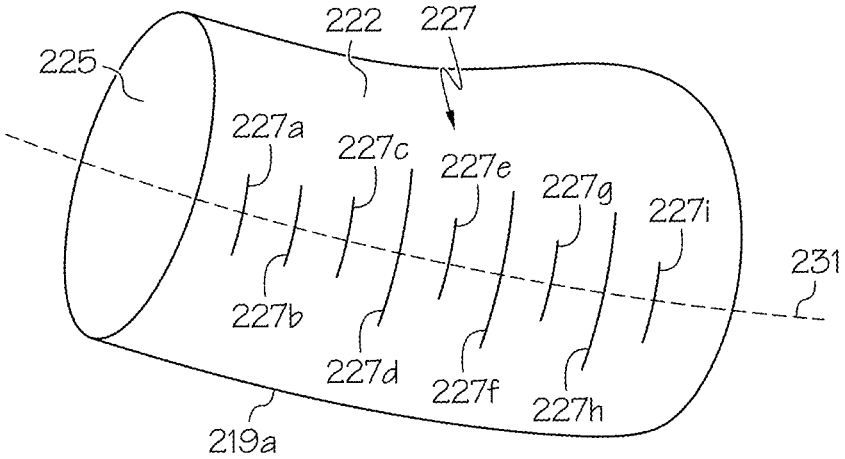
FIG. 18A illustrates a side view showing sewn darts of a sleeve portion of the support shirt of FIG. 13.
Figure 18B:
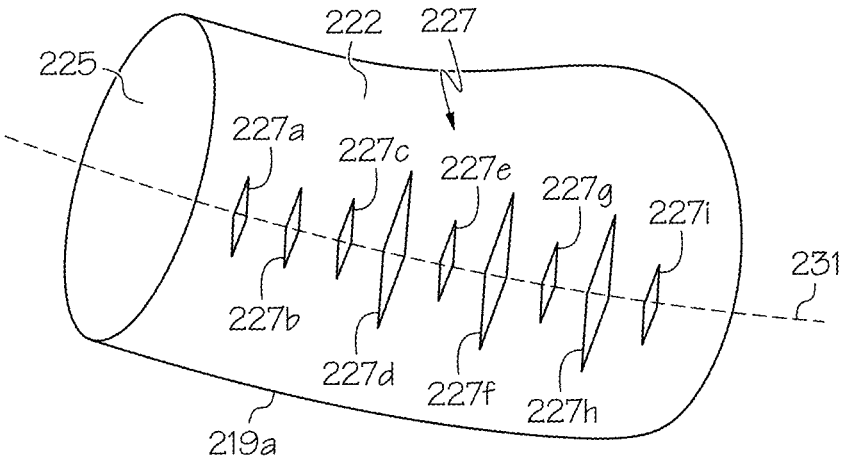
FIG. 18B illustrates a side view showing unsewn cut-outs of a sleeve portion of the support shirt of FIG. 13.
Figure 18C:
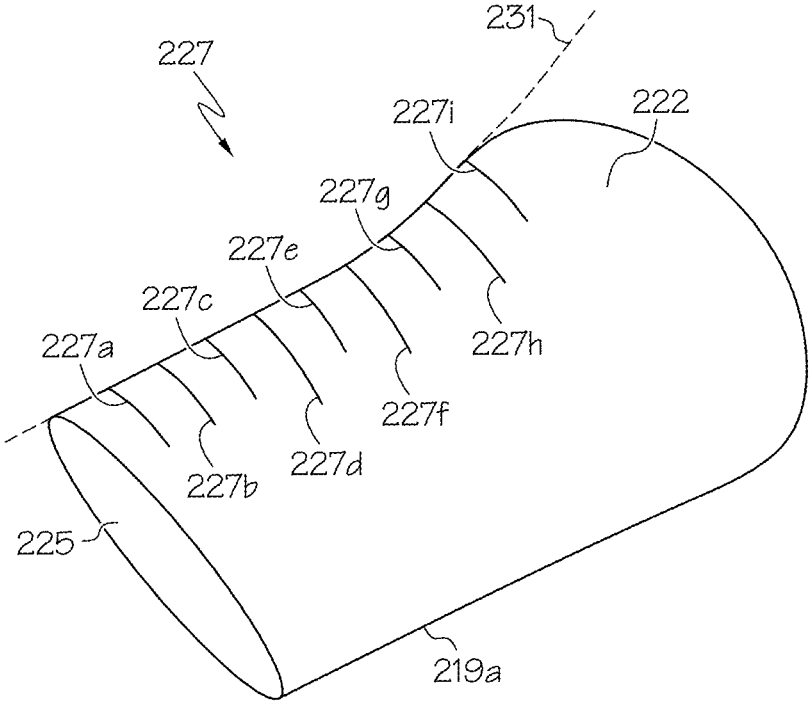
FIG. 18C illustrates a perspective view of a sleeve portion showing the gradual curvature of the sleeve portion of the support shirt of FIG. 13 along the centerline.

Sleeve portions 219*a* and 219*b* extend in a forward direction relative to a frontal plane 204 of shirt body 211 and a downward direction relative to a transverse plane 206 of shirt body 211 as shown in FIGS. 16 and 17. As shown in FIG. 17, sleeve portions 219*a* and 219*b* have a first central angle 237 of approximately 95° relative to frontal plane 204. As shown in FIG. 16, sleeve portions 219*a* and 219*b* have a second central angle 239 of approximately 30° relative to transverse plane 206. As previously described, angles 237 and 239 may vary over a broad range depending on the desired end use for the shirt.

Figure 19:
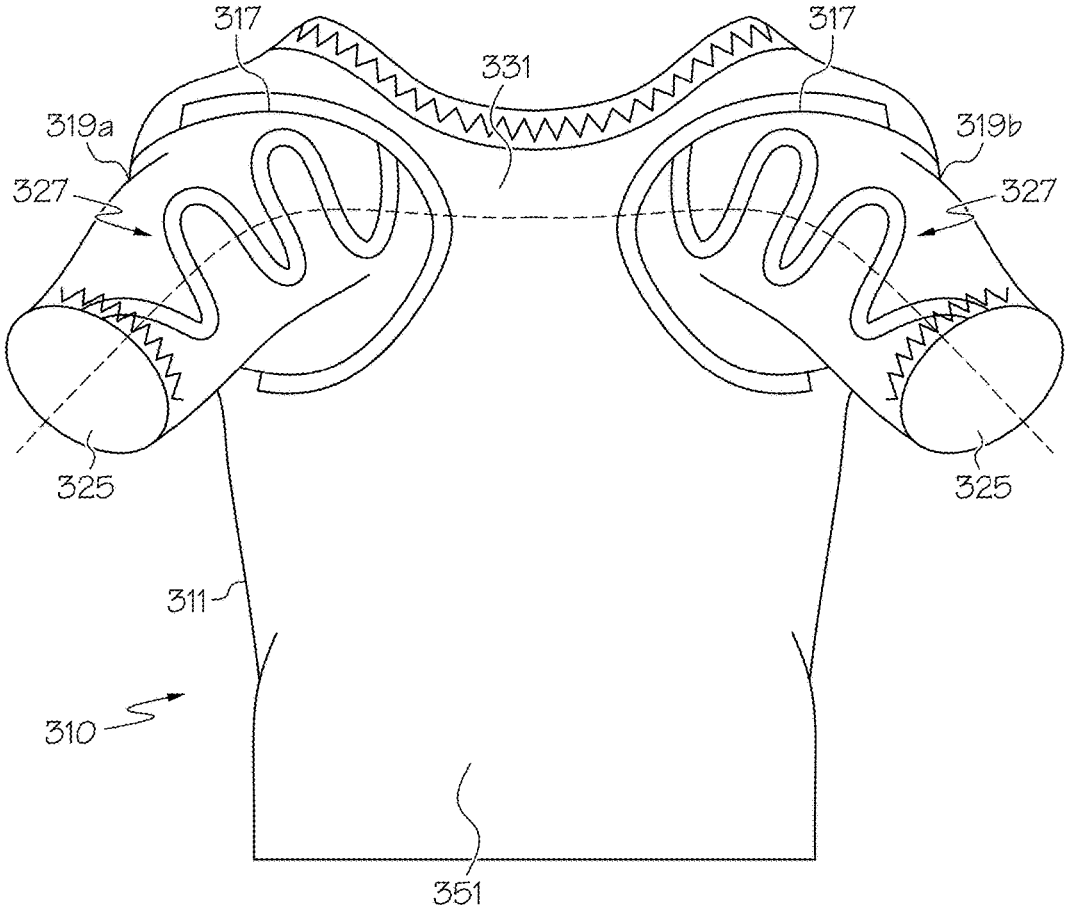
FIG. 19 illustrates a front view of a support shirt of yet another alternate embodiment.
Figure 20:
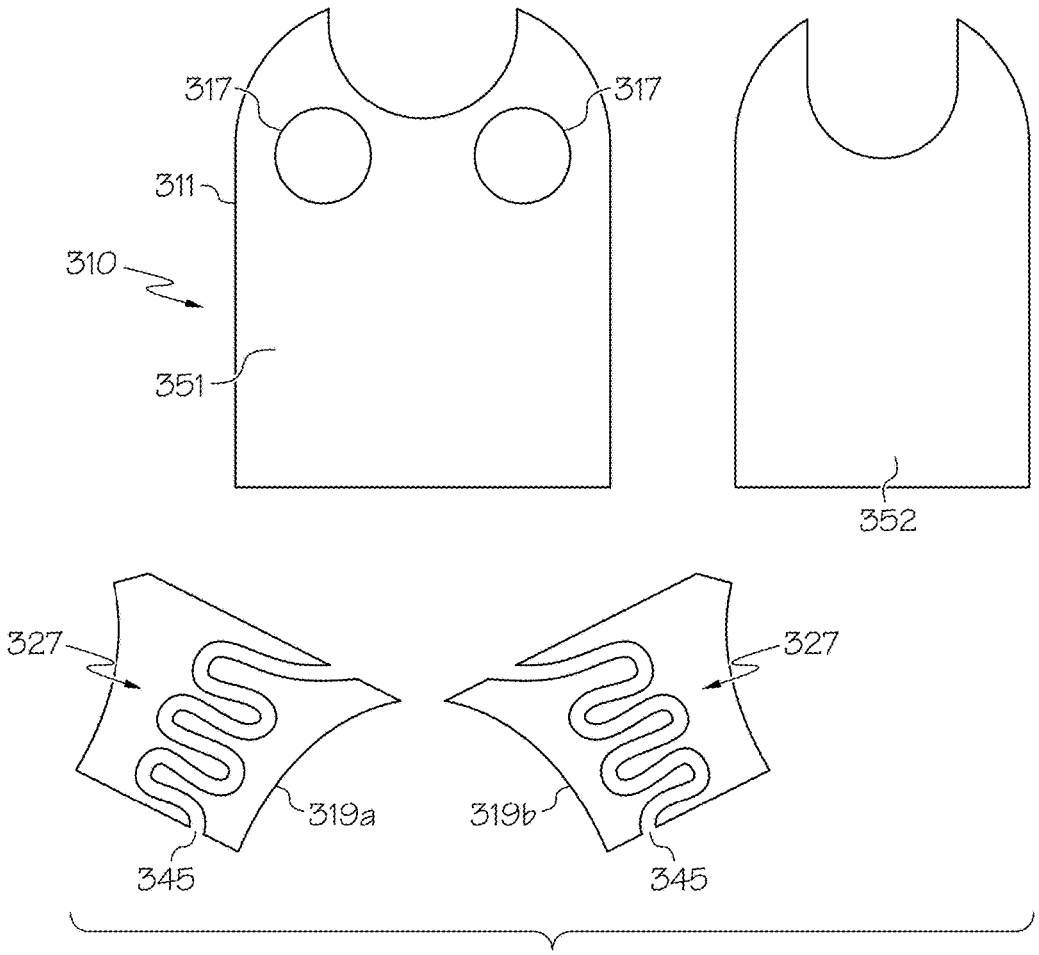
FIG. 20 illustrates patterns of the front, back, and sleeves as cut from fabric to assemble the support shirt of FIG. 19.

A further alternate embodiment is shown in FIGS. 19-22. In this embodiment, support shirt 310 comprises a shirt body 311, a shirt front 351 and shirt back 352 joined at a body seam 353, sleeve arm holes 317 and sleeve portions 319*a* and 319*b*. Sleeve openings 325 oppose the sleeve holes 317. The sleeve portions 319*a* and 319*b* comprise front sleeve portions 322, and rear sleeve portions 323. A centerline 331 extends along the front sleeve portions 322 and the upper portion of the front of the shirt as best shown in FIG. 19.

Figure 21:
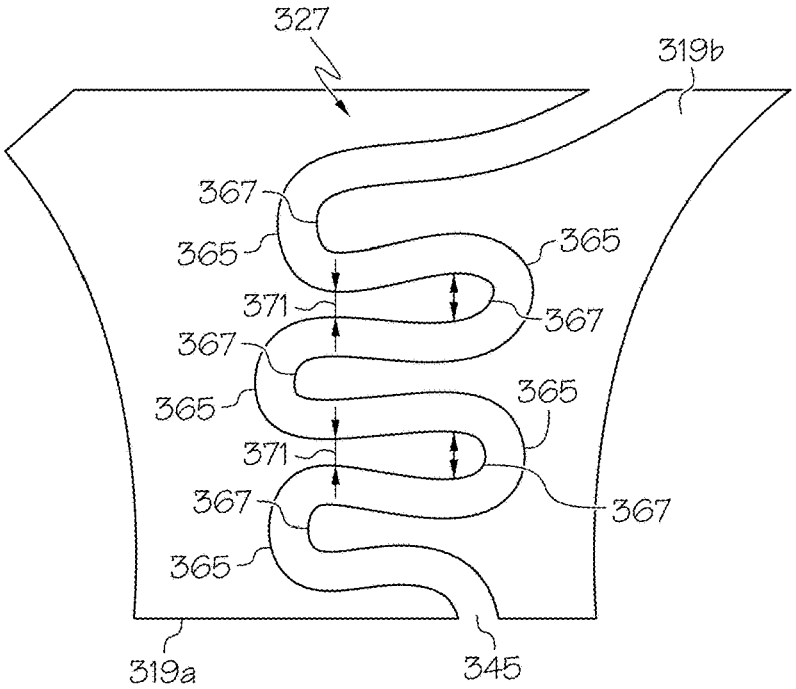
FIG. 21 illustrates a front view of a support shirt of yet another alternate embodiment.

A sinusoidal waveform patterned tilting region 327 is located on each of the sleeve portions 319*a* and 319*b*. Each waveform tilting region 327 comprises a coupling seam 345. The coupling seam 345 is located on the front sleeve portions 322, and extends in a sinusoidal waveform along the centerline 331, as shown in FIGS. 19-22. The waveform tilting region 327 includes a plurality of recesses 365 and projections or lobes 367 which, when gathered and sewn together, form the periphery of the coupling seam 345 as shown in FIG. 21. As shown in FIG. 21, each projection 367 has width 373 at its distal tip which is greater than a width 371 adjacent its base. Typically, the amplitude of the waveform pattern (distance from tip to base) is from about 0.25 to about 1.5 inches, while the repeat length of the pattern may range from about 2 to about 4 inches. Alternatively, the width 373 of the distal tip of each projection 367 may be less than the width 371 adjacent the base.

Figure 22:
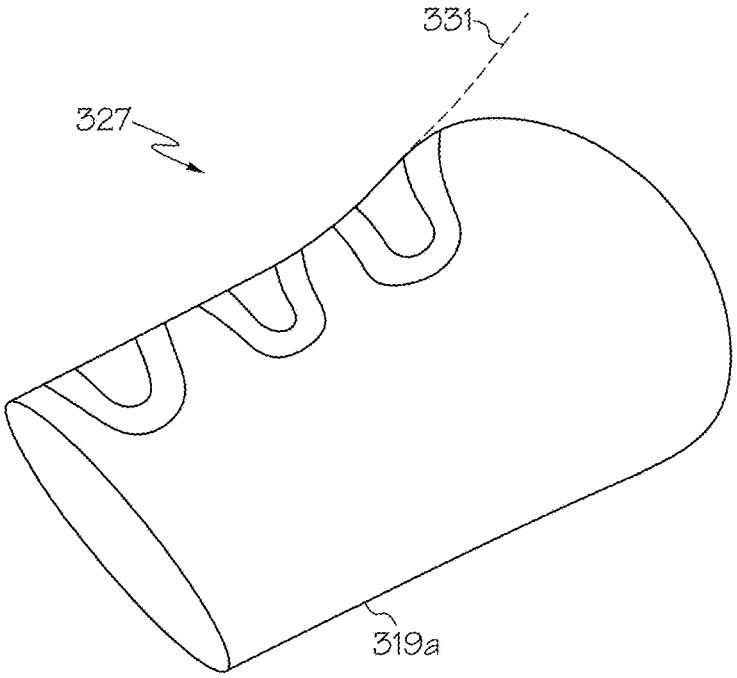
FIG. 22 illustrates a perspective view along the plane of the centerline of the assembled sleeve portion of the support shirt of FIG. 19 showing the gradual curvature of the sleeve.

Each projection 367 fits into a corresponding recess 365 in the waveform pattern. The sleeve portions 319*a* and 319*b* are sewn together at the coupling seam 345. Because of the differences in width between the base and distal tip of respective projections 367, the coupling seam 345 functions to gather the fabric and causes a gradual curvature or tilt of the sleeve portions 319*a* and 319*b*, as shown in FIG. 22.

Figure 27:
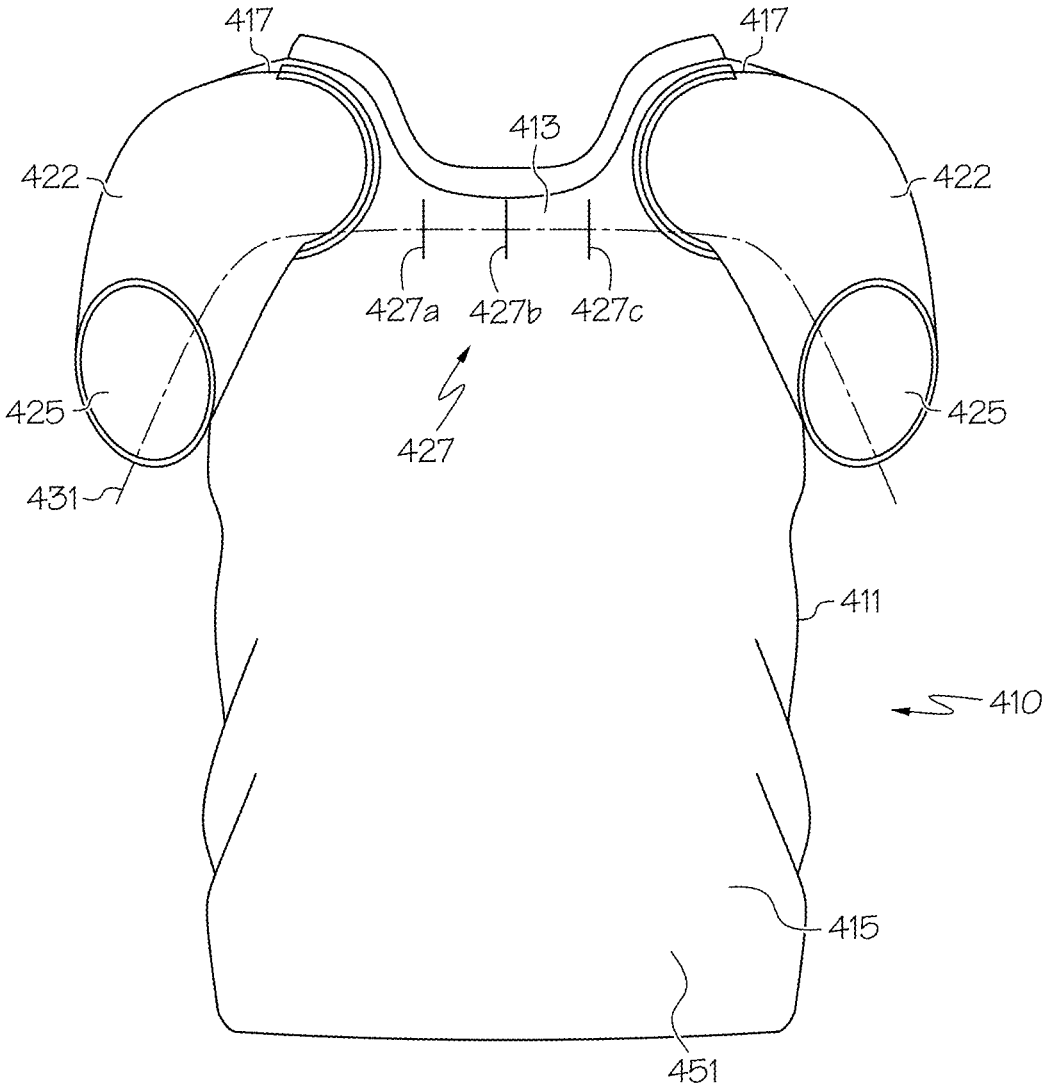
FIG. 27 illustrates a front view of yet another embodiment of the support shirt.

FIG. 27 illustrates yet another embodiment of the support shirt in which a support shirt 410 comprises a shirt body 411, upper shirt body 413, lower shirt body 415, sleeve arm holes 417 and sleeve portions 419*a* and 419*b*. The sleeve arm holes 417 are positioned near upper shirt body 413, corresponding with the area of traversal of the wearer's arms. Sleeve openings 425 oppose the sleeve holes 417. Sleeve portions 419*a* and 419*b* comprise front sleeve portions 422, and rear sleeve portions 423. A centerline 431 extends along the front sleeve portions 422 and upper shirt body 413 as shown.

A tilting region 427 is located on the front of shirt body 411. In this embodiment the tilting region includes three darts 427*a*, 427*b*, and 427*c*, sewn such that the darts are substantially perpendicular to the vertical axis of the shirt body. The darts 427*a*, 427*b*, and 427*c* are formed initially as oval or diamond-shaped cut-outs which, when gathered and sewn together, cause the front portion of the upper shirt body to gradually tilt and curve inwardly, resulting in sleeve portions 419*a* and 419*b* to also curve inwardly. Alternatively, the darts may be formed by gathering or puckering the fabric of the shirt body and secured by, for example, stitching, welding, or adhering the material.

The construction, material, and configuration of the elements described herein may vary. For example, the support shirt could also exist without a lower torso area, and/or without a shirt back.

Bench press shirts may be comprised of numerous materials including synthetic and non-synthetic fibers. The support shirt of embodiments herein provided support/and or compression during athletic activities, and therefore have greater tensile strength than conventional shirts. The support shirts may or may not have elastic properties. For example, embodiments may utilize fabrics such as neoprene or spandex. Additionally, other embodiments may comprise stretch fabric including either two-way or four-way stretch.

The tilting region may comprise a differing number of darts sewn into the sleeve portions. Moreover, the length of each dart may differ. Therefore, the spirit and scope of the appended claims should not be limited to the descriptions of the specific embodiments described herein.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Unless the meaning is clearly to the contrary, all ranges set forth herein are deemed to be inclusive of all values within the recited range as well as the endpoints.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A support shirt comprising a shirt body and a pair of sleeves comprised of fabric, each of said sleeves being attached to said shirt body and having respective separate front and rear sleeve portions joined together at respective seams, said support shirt including at least one area of increased support comprising a curved tilting region extending along at least a portion of a centerline forming a curvilinear axis that extends longitudinally across respective front portions of said sleeves and an upper portion of said shirt body to stabilize and provide support to the shoulders of a wearer during a lifting motion, and wherein said tilting region comprises at least one dart forming a seam on respective front sleeve portions of said support shirt.

2. The support shirt as claimed in claim 1 in which said tilting region comprises an upper portion of said shirt body.

3. The support shirt as claimed in claim 2 in which said tilting region comprises a plurality of darts, and said darts comprise cut-out areas on said upper portion of said shirt body.

4. The support shirt as claimed in claim 3 in which said cut-out areas are diamond shaped or oval-shaped.

5. The support shirt as claimed in claim 2 in which said tilting region comprises a plurality of darts formed by gathering said fabric.

6. The support shirt as claimed in claim 1 in which said at least one dart extends substantially perpendicular to said centerline.

7. The support shirt as claimed in claim 1 in which said tilting region comprises more than one dart.

8. The support shirt as claimed in claim 1 in which said tilting region comprises a plurality of darts, and said darts comprise cut-out areas on said front sleeve portions.

9. The support shirt as claimed in claim 8 in which said cut-out areas are diamond shaped or oval-shaped.

10. The support shirt as claimed in claim 1 in which said tilting region comprises a plurality of darts formed by gathering said fabric on said front sleeve portions.

11. The support shirt as claimed in claim 1 in which said shirt body includes a front and a back, said front including a pair of sleeve arm holes, with respective sleeves attached at respective sleeve arm holes.

12. The support shirt as claimed in claim 1 in which said sleeves curve inwardly to form at least a portion of said curvilinear axis.

13. A support shirt comprising a shirt body and a pair of sleeves comprised of fabric, each of said sleeves being attached to said shirt body and having respective front and rear sleeve portions, said support shirt including at least one area of increased support comprising a tilting region extending along at least a portion of a centerline forming a curvilinear axis that extends longitudinally across respective front portions of said sleeves and an upper portion of said shirt body to stabilize and provide support to the shoulders of a wearer during a lifting motion, said tilting region comprising a coupling seam extending in a waveform pattern and joining said front and rear sleeve portions, and in which said front and rear sleeve portions include a plurality of recesses and projections which are joined together at said coupling seam.

14. The support shirt as claimed in claim 13 in which each of said projections has a width at its distal tip which is greater than a width at its base.

15. The support shirt as claimed in claim 13 in which said shirt body and sleeve portions comprise a single or multiple ply fabric comprised of canvas, polyester, spandex, nylon, or cotton.

16. The support shirt as claimed in claim 15 in which said fabric has a tensile strength of at least 90 psi.

17. The support shirt as claimed in claim 13 in which said sleeve portions extend forwardly of a frontal plane extending across said support shirt body at an angle of from about 60 to about 180°.

18. The support shirt as claimed in claim 17 in which said sleeve portions extend from a transverse plane extending substantially perpendicular to said frontal plane at an angle of from between +45° to −45°.

19. The support shirt as claimed in claim 17 in which each of said sleeve portions have a length and include a central angle relative to said frontal plane, wherein said tilting region includes at least one dart which causes said central angle to decrease relative to said frontal plane along the length of each of said sleeve portions.

20. The support shirt as claimed in claim 13 in which said waveform pattern comprises a sinusoidal waveform pattern.

* * * * *